US011293719B2

(12) United States Patent
Gadams

(10) Patent No.: US 11,293,719 B2
(45) Date of Patent: Apr. 5, 2022

(54) MOUNTING ASSEMBLY AND METHODS OF MAKING AND USING THE SAME

(71) Applicant: HSG, LLC, Swansboro, NC (US)

(72) Inventor: Matthew Joseph Gadams, Swansboro, NC (US)

(73) Assignee: HSG, LLC, Swansboro, NC (US)

( * ) Notice: Subject to any disclaimer, the term of this patent is extended or adjusted under 35 U.S.C. 154(b) by 0 days.

(21) Appl. No.: 17/143,190

(22) Filed: Jan. 7, 2021

(65) Prior Publication Data

US 2021/0123703 A1 Apr. 29, 2021

Related U.S. Application Data

(63) Continuation of application No. 16/594,165, filed on Oct. 7, 2019, now Pat. No. 10,890,413.

(60) Provisional application No. 62/741,865, filed on Oct. 5, 2018.

(51) Int. Cl.
*F41C 33/04* (2006.01)
*A45F 5/02* (2006.01)

(52) U.S. Cl.
CPC ..... *F41C 33/041* (2013.01); *A45F 5/021* (2013.01); *A45F 2200/0591* (2013.01)

(58) Field of Classification Search
CPC . F41C 33/041; A45F 5/021; A45F 2200/0591
USPC ..... 224/242
See application file for complete search history.

(56) References Cited

U.S. PATENT DOCUMENTS

| | | | | |
|---|---|---|---|---|
| 5,351,868 | A * | 10/1994 | Beletsky | A45C 11/00 224/245 |
| 6,237,820 | B1 * | 5/2001 | Saxton | A45F 3/16 215/395 |
| 7,562,482 | B1 * | 7/2009 | Johnson | F41A 9/63 42/50 |
| 8,011,544 | B1 * | 9/2011 | Howell | F42B 39/02 224/668 |
| 8,231,038 | B2 * | 7/2012 | Felts | A45F 5/02 224/665 |
| 8,485,405 | B2 * | 7/2013 | Crye | F42B 39/02 224/666 |
| 8,887,972 | B2 * | 11/2014 | Solomon | A45F 5/021 224/245 |
| 9,394,080 | B2 * | 7/2016 | Beck | F42B 39/26 |
| 9,759,536 | B2 * | 9/2017 | Gadams | B65D 25/20 |
| 9,795,210 | B2 * | 10/2017 | Evans | F42B 39/02 |
| 10,197,370 | B2 * | 2/2019 | Zhang | F42B 39/02 |
| 10,306,973 | B2 * | 6/2019 | Evans | A45F 5/02 |
| 10,537,167 | B2 * | 1/2020 | Bryant | F42B 39/02 |

(Continued)

*Primary Examiner* — Peter N Helvey
(74) *Attorney, Agent, or Firm* — NK Patent Law

(57) ABSTRACT

Mounting assembly used to secure an object in a desired location, and also allow for the quick and efficient relocation of the object to a new location is provided as a two-piece assembly comprising a clip and corresponding fastener. The fastener is coupled to an object (such as a gun holster), and the clip is provided at a desired location. The fastener and the clip can be releasably coupled together, providing a support for the object attached to the fastener. The mounting assembly can be decoupled by activating a pair of tabs configured on the fastener. The fastener and associated object (e.g., gun holster) can therefore be quickly and easily moved from a first location to a second location, such as from a belt attachment to a carrier or other device.

20 Claims, 6 Drawing Sheets

(56) References Cited

U.S. PATENT DOCUMENTS

| | | | | |
|---|---|---|---|---|
| 10,571,220 | B2 * | 2/2020 | Toschi | F41C 33/04 |
| 10,605,574 | B2 * | 3/2020 | Swan | F41H 1/02 |
| 10,612,888 | B2 * | 4/2020 | Toschi | F41C 33/0227 |
| 2005/0045681 | A1 * | 3/2005 | Hancock | B60R 11/0205 224/401 |
| 2007/0278269 | A1 * | 12/2007 | Rogers | F41A 9/65 224/239 |
| 2016/0003598 | A1 * | 1/2016 | Gadams | F42B 39/02 206/3 |
| 2016/0209163 | A1 * | 7/2016 | VanHeusen | A45F 5/00 |

* cited by examiner

MOUNTING ASSEMBLY AND METHODS OF MAKING AND USING THE SAME

CROSS-REFERENCE TO RELATED APPLICATIONS

This application is a continuation of U.S. patent application Ser. No. 16/594,165 filed on Oct. 7, 2019, issuing as U.S. Pat. No. 10,890,413 on Jan. 12, 2021, which claims priority to U.S. Provisional Patent Application No. 62/741,865 filed on Oct. 5, 2018, the entire contents of which are incorporated by reference herein.

TECHNICAL FIELD

The presently disclosed subject matter relates to a mounting assembly that allows an object to be easily moved between multiple locations. In particular, the presently disclosed subject matter directed to methods of making and using a mounting assembly for an object such as a gun holster.

BACKGROUND

Holsters are well known articles for carrying and/or concealing guns and other weapons or items on a user's body or within reach of the user. Many holsters are designed for wearing on a belt or waistband of the user's pants, while others include harnesses or straps for wearing around the torso, arms, legs, ankles or the like. In each case the holsters are mounted through a belt or strap passing through a closed loop. Such an arrangement necessitates the loosening of the open end of the belt or strap to mount or remove the holster. The arrangement further limits the areas on which a receptacle can be carried and/or mounted. In addition, holsters existing in the market require time and effort to change the location of the holster, as it must be unthreaded from the belt or strap, and then rethreaded on a new location.

It would therefore be beneficial to provide a mounting assembly that can be utilized to removably secure holsters, sheaths, and other similar receptacles on a belt, garment, or any of a wide variety of other items. It would further be beneficial if the mounting assembly allowed the attached item to be moved to a new location quickly and easily.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

In some embodiments, the presently disclosed subject matter is directed to a mounting assembly. Particularly, the mounting assembly comprises a fastener defined by a base comprising a top face and a bottom face. An extension positioned at a first end of the top face of the base, the extension comprising a central aperture. A ridge positioned at a second end of the top face of the base, the ridge comprising a central opening and a pair of opposing side faces, wherein each side face comprises a tab. The tabs are joined by a mounting pin that extends through the central opening. The tabs are moveable towards the first end of the fastener, and are configured such that when the tabs are moved, the mounting pin is correspondingly moved. The mounting assembly further comprises a clip defined by a main body comprising a top face and a bottom face, and an arm positioned at a first end of the bottom face of the clip, wherein the arm is configured to fit within an aperture on the fastener. The clip further comprises a tapered segment positioned at a second end of the bottom face of the clip, wherein the tapered segment comprises a lip that is configured to cooperate with the mounting pin.

According to one or more embodiments, an item is removably attached to the fastener.

According to one or more embodiments, an extension of the fastener, a ridge of the fastener, or both extend perpendicularly away from the top face of the base.

According to one or more embodiments, the base, the main body, or both comprise one or more through holes.

According to one or more embodiments, the through holes comprise screw threads.

According to one or more embodiments, the base and the main body are configured to have about the same size, shape, or both size and shape.

According to one or more embodiments, the tabs comprise one or more gripping elements.

According to one or more embodiments, the fastener and the clip are constructed from one or more rigid materials.

According to one or more embodiments, the mounting assembly is configured in an about rectangular shape.

In some embodiments, the presently disclosed subject matter is directed to a method of attaching an item to a mounting assembly. Particularly, the method comprises attaching a fastener of the mounting assembly to the item. The fastener comprises a base comprising a top face and a bottom face, an extension comprising a central aperture is positioned at a first end of the top face of the base, and a ridge comprising a central opening positioned at a second end of the top face of the base. The ridge comprises a pair of opposing side faces, each side face comprising a tab, wherein the tabs are joined by a mounting pin that extends through the central opening. The tabs are moveable towards the first end of the fastener and are configured such that when the tabs are moved, a mounting pin is correspondingly moved. The method further comprises attaching a clip of the mounting assembly to an object. The clip is defined by a main body comprising a top face and a bottom face, and an arm positioned at a first end of the bottom face of the clip, wherein the arm is configured to fit within an aperture on the fastener. The clip further includes a tapered segment positioned at a second end of the bottom face of the clip, wherein the tapered segment comprises a lip that is configured to cooperate with the mounting pin. The method further comprises attaching the item to the bottom face of the base of the fastener, positioning an arm of the clip in the aperture on the fastener to couple the first ends of the clip and fastener together, and positioning the lip to grip the mounting pin of the fastener to couple the second ends of the clip and fastener together. The fastener can be uncoupled from the clip by advancing the tabs to the first end of the fastener, such that the lip no longer grips the mounting pin, thereby separating the second ends of the fastener and clip. The method can further compromise removing the arm of the clip from the aperture on the fastener.

According to one or more embodiments, the item is removably attached to the fastener.

According to one or more embodiments, an extension of the fastener, a ridge of the fastener, or both extend perpendicularly away from the base, towards the clip when the mounting assembly is coupled together.

According to one or more embodiments, the base, the main body, or both comprise one or more through holes.

According to one or more embodiments, the through holes comprise screw threads.

According to one or more embodiments, the base and the main body are configured to have about the same size, shape, or both size and shape.

According to one or more embodiments, the tabs comprise one or more gripping elements.

According to one or more embodiments, the fastener and the clip are constructed from one or more rigid materials.

According to one or more embodiments, the mounting assembly is configured in an about rectangular shape.

According to one or more embodiments, the item is or can be a gun holster.

According to one or more embodiments, the object is or can be a belt of a user or a bag of a user.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "an object" can include a plurality of such objects, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1A:
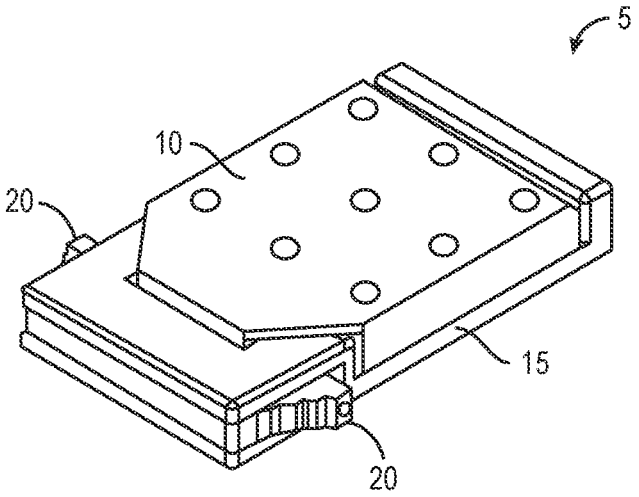
FIG. 1A is a perspective view of a mounting assembly in accordance with some embodiments of the presently disclosed subject matter.
Figure 1B:
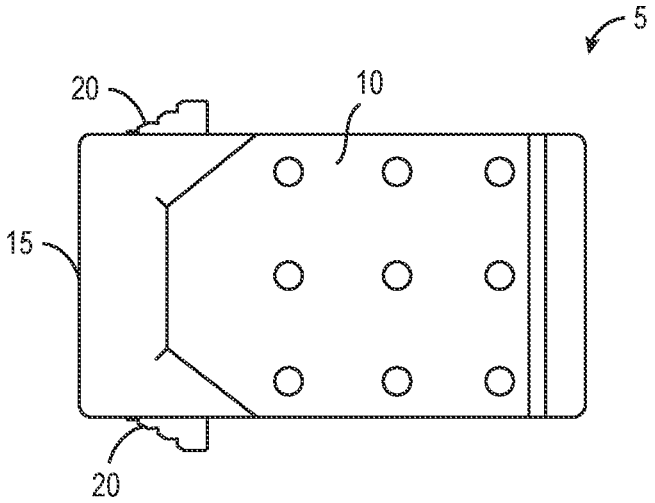
FIG. 1B is a top plan view of the mounting assembly of FIG. 1A.
Figure 1C:
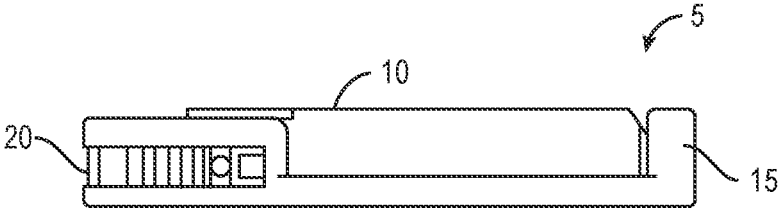
FIG. 1C is a side plan view of the mounting assembly of FIG. 1A.

FIGS. 1A-1C illustrate one embodiment of mounting assembly 5 that can be used to secure an object in a desired location; mounting assembly 5 can also allow for the quick and efficient relocation of the object to a new location. As illustrated, the mounting assembly is provided as a two-piece assembly comprising clip 10 and fastener 15. In the subject disclosure, fastener 15 is coupled to an object (such as a gun holster), and clip 10 is provided at a desired location. The fastener and the clip can be releasably coupled together, providing a support for the object attached to fastener 15. As set forth in detail herein below, mounting assembly 5 can be decoupled by activating tabs 20, which release the clip from the fastener. The fastener 15 and associated object (e.g., a gun holster) can therefore be quickly and easily moved from a first location to a second location, such as from a belt attachment to a carrier or other device.

Figure 2A:
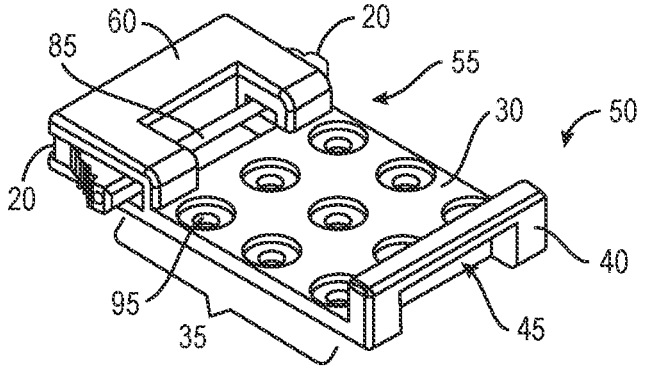
FIGS. 2A and 2B are perspective view of a top side of a mounting assembly fastener in accordance with some embodiments of the presently disclosed subject matter.
Figure 2B:
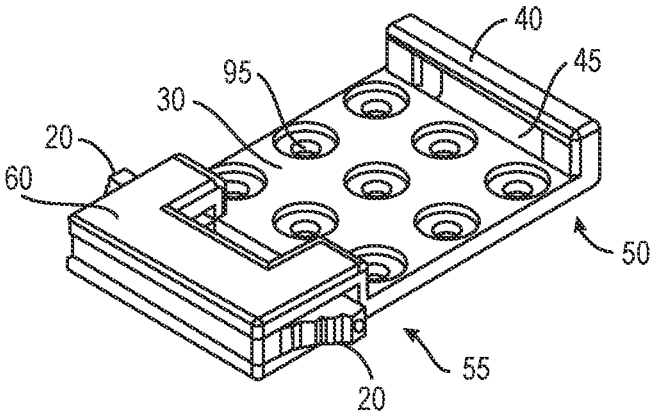

FIGS. 2A and 2B illustrate top perspective views of one embodiment of fastener 15. As shown, fastener 15 comprises top face 30 that faces and directly contacts clip 10 when the mounting assembly is in a coupled orientation (i.e., when the clip and the fastener are coupled together). Fastener 15 further comprises an opposed bottom face configured as a relatively flat and smooth surface that faces the external environment when the clip is coupled with the fastener.

The top face includes recessed base 35 that is sized and shaped to abut the body of clip 10, as described below. In some embodiments, base 35 can be constructed as a square or rectangle, although it should be appreciated that it can be configured in any desired shape (e.g., oval, round, triangular, hexagonal, pentagonal, abstract, and the like) so long as it cooperates with the corresponding body of the clip; accordingly, the clip can be configured in any desired corresponding shape. In some embodiments, base 35 can have about the same length and/or width as the clip body.

Top face 30 of fastener 15 comprises extension 40 that extends from an edge at first end 50 of the fastener in an upward direction (e.g., towards the clip when the mounting assembly is coupled together). As illustrated in FIG. 2B, for example, extension 40 comprises aperture 45. In some embodiments, the aperture can be configured in a rectangular shape, although any desired shape can be used. Aperture 45 is sized and shaped to cooperate with a corresponding arm 120 on clip 10, as set forth in more detail below.

The top face of fastener 15 further comprises ridge 60 configured at second end 55 that extends in an upward direction (i.e., towards the clip when the mounting assembly is coupled together). In some embodiments, the ridge can have about the same height as extension 40. Ridge 60 comprises opening 70 that can be configured in any desired shape (e.g., rectangular or square).

Figure 2C:
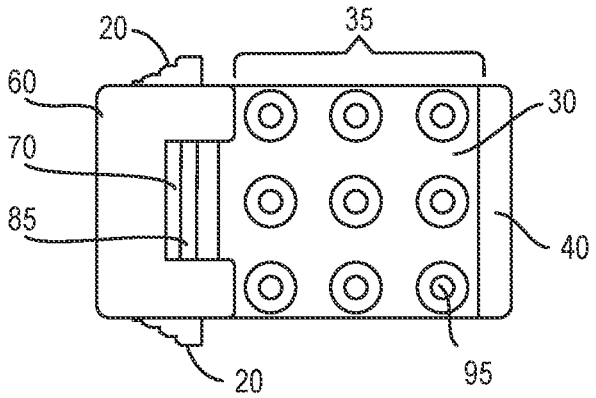
FIG. 2C is a top plan view of the fastener of FIG. 2A.
Figure 2D:
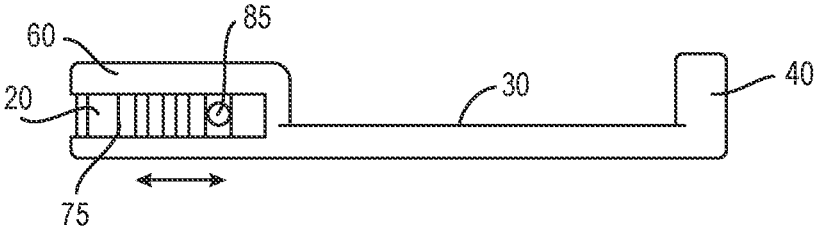
FIG. 2D is a side plan view of the fastener of FIG. 2A.

Ridge 60 includes tabs 20 positioned on fastener side faces 80, as shown in FIG. 2C. The tabs can be maneuvered between a first position and a second position by sliding forward and backward, as illustrated by the arrow in FIG. 2D. Pin 85 spans the two tabs, passing through opening 70. The pin is therefore visible in the opening and is accessible to clip 10 during coupling. The mounting pin can be constructed from any desired rigid material, including (but not limited to) metal, plastic, wood, and the like. Because pin 85 is held between the two tabs, it slides forward and backwards with the tabs. In this way, clip 10 is held and released from the fastener, as described in more detail below.

In some embodiments, tabs 20 can include one or more gripping elements 75 to allow the user to easily handle the tabs when locking or releasing clip 10. For example, the gripping elements can include one or more raised ridges, rubber grips, textured regions, and the like.

Base 35 of the fastener can include one or more holes 95, as illustrated in FIGS. 2A-2C. Holes 95 allow one or more mechanical elements (e.g., screws, rivets) to pass therethrough, to attach fastener 15 to a desired item, such as a plate, a gun holster, a knife, a tool, a device, etc. In some embodiments, the holes can be threaded. In addition, holes 95 operate to reduce the overall weight of the fastener and thus add a lightweight quality, allowing for increased ease of use.

Figure 3A:
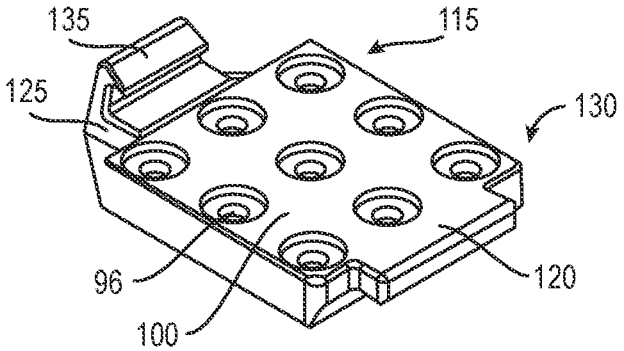
FIG. 3A is a perspective view of a mounting assembly clip in accordance with some embodiments of the presently disclosed subject matter.
Figure 3B:
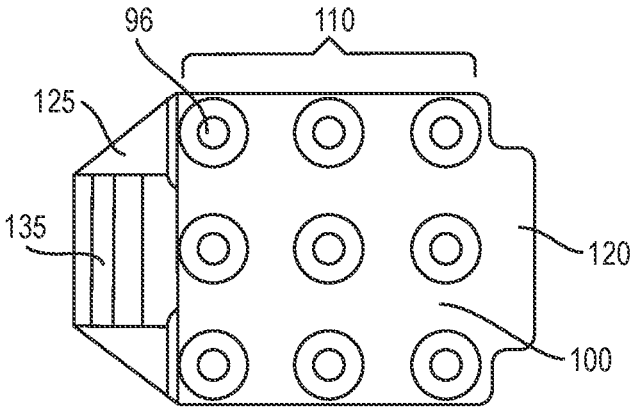
FIG. 3B is a top plan view of the clip of FIG. 3A.
Figure 3C:
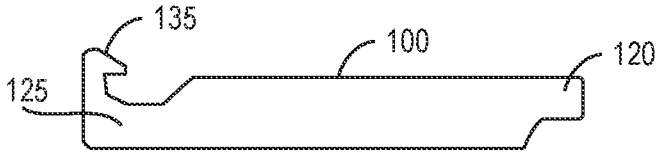
FIG. 3C is a side plan view of the clip of FIG. 3A.

FIGS. 3A-3C illustrate one embodiment of clip 10. The clip includes top face 100 that faces and directly contacts the fastener when the mounting assembly is coupled together. The clip further includes a substantially flat bottom face that faces the exterior environment when attached to fastener 15.

As shown, clip 10 includes body 110 that is sized and shaped to abut and directly contact base 35 of the fastener. First end 115 of the clip body includes arm 120 that is sized and shaped to fit into aperture 45 on first end 50 of the fastener. In this way, the first ends of the fastener and clip are coupled together when arm 120 is fit into aperture 45.

Second end 130 of the clip body includes tapered segment 125 comprising lip 135 that is sized and shaped to fit into opening 70 of the fastener. Specifically, the lip is configured to grasp pin 85. In some embodiments, lip 135 can be configured in a "J" or "C" shape in order that it matingly engages the pin. The lip attaches to the pin and maintains second ends 130, 55 of the clip and fastener in a coupled configuration. To release the fastener from the clip, the user simply grips tabs 20 and moves them forward (towards first end 50 of the fastener). The lip of the clip can then be easily unhooked from pin 85. FIG. 3C illustrates a side plan view of the clip, illustrating one embodiment of lip 135.

Similar to the fastener, clip 10 can include one or more holes 96, as illustrated in FIGS. 3A and 3B. Holes 96 allow one or more mechanical elements (e.g., screws, rivets) to pass therethrough and attach the clip to a desired item, such as a plate, belt, bag, etc.

Clip 10 and fastener 15 can be constructed from any desired rigid material. The term "rigid" as used herein refers to material that is substantially non-pliable and retains its shape when subjected to stress. Suitable rigid materials can include, but are not limited to, metal (e.g., stainless steel, aluminum, galvanized metal), plastic (polyethylene, PVC), wood, or combinations thereof. The clip and fastener can be constructed using any known method. For example, suitable extrusion, stamping, machining, and/or injection molding techniques can be used to manufacture the clip and fastener.

It should be appreciated that the disclosed mounting assembly can be configured in any desired size, depending on the size of the item to be moved. For example, when used with a gun holster, the assembly can have a length and/or height of about 3-6 inches (e.g., 3, 3.25, 3.5, 3.75, 4, 4.25, 4.5, 4.75, 5, 5.25, 5.5, 5.75, or 6 inches). However, the presently disclosed subject matter is not limited and can be configured to be larger or smaller than the range given above.

In use, fastener 15 is attached to a particular object that is to be moved from a first to a second location. In one example, the fastener can be attached to a gun holster, thereby allowing the associated gun to be moved between locations (e.g., between a hunting bag and a user's belt). The object can be attached to the fastener using any known attachment mechanism, including (but not limited to) the use of one or more adhesives, mechanical closures (e.g., clips, screws, bolts, etc.), hook-and-loop closures, and the like.

Figure 4A:
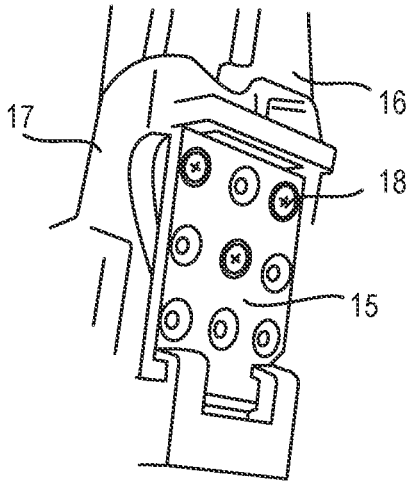
FIG. 4A is a perspective view of a fastener in use in accordance with some embodiments of the presently disclosed subject matter.

FIG. 4A illustrates one embodiment of fastener 15 attached to object 16 (a gun holster). As shown, the fastener can be attached to object 16 through the use of one or more adaptors (e.g., bracket 17) and/or screws 18. As would be known in the art, the screws can be removed to detach the fastener from the plate at any desired time. Alternatively, the fastener can be directly attached to the object.

Figure 4B:
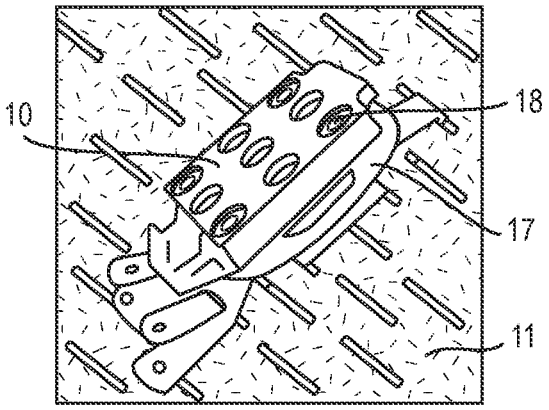
FIG. 4B is a perspective view of a clip in use in accordance with some embodiments of the presently disclosed subject matter.

FIG. 4B illustrates one embodiment of clip 10 attached to item 11 (e.g., a hunting bag). As illustrated, the clip can be removably attached to the bag through the use of an adaptor, configured as bracket 17 and/or screws 18.

Figure 5A:
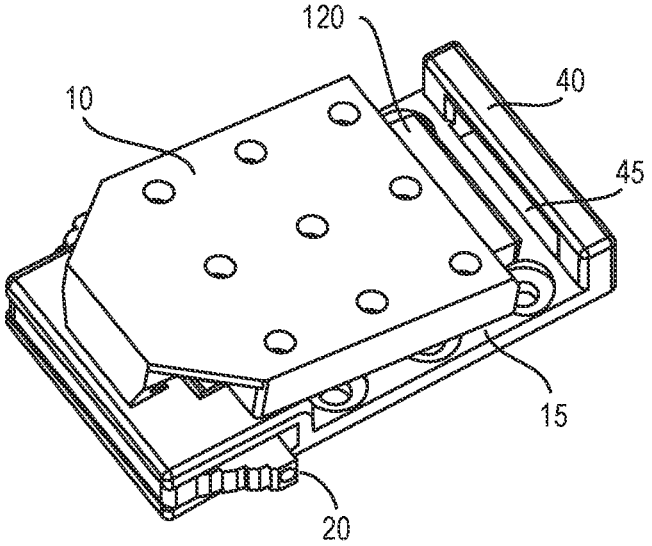
FIG. 5A is a perspective view of one way to couple the clip and fastener wherein the clip is about to be coupled with the fastener in accordance with some embodiments of the presently disclosed subject matter.
Figure 5B:
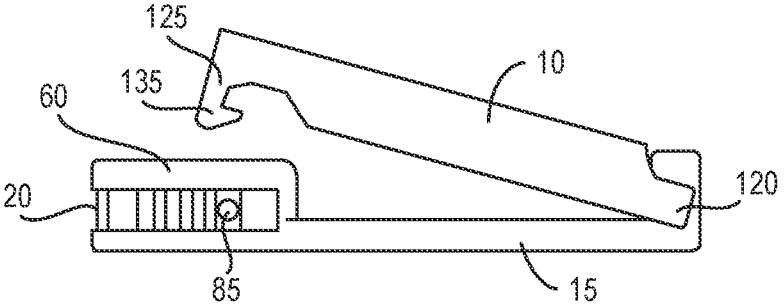
FIG. 5B is a side plan view of one way to couple the clip and fastener wherein the clip is about to be coupled with the fastener in accordance with some embodiments of the presently disclosed subject matter.
Figure 5C:
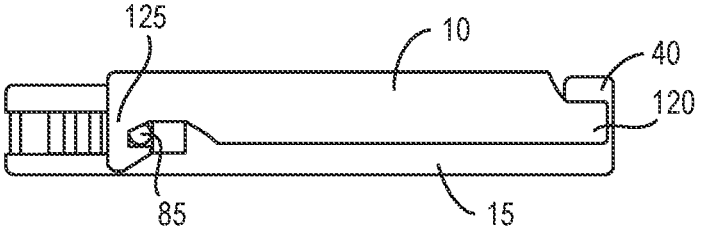
FIG. 5C is a side plan view of one way to couple the clip and fastener wherein the clip has been coupled with the fastener in accordance with some embodiments of the presently disclosed subject matter.

In terms of operating the mounting assembly, to couple the clip and fastener together, arm 120 of the clip is inserted into aperture 45 of the fastener, as shown in FIG. 5A. The arm is sized and shaped to closely fit into the aperture, thereby maintaining the first ends of the clip and fastener in a joined or coupled configuration. As discussed above, lip 135 of the clip is adapted to engage pin 85 accessible in opening 70 of the fastener to thereby join second end 130 of the clip with the second end of the fastener. Particularly, the lip is advanced towards opening 70, as shown in FIG. 5B. The pin is advanced towards lip 135 by the sliding action of the tabs (e.g., the tabs are maneuvered towards the lip). The lip then latches the pin and keeps the fastener and clip closely attached together, such that the top faces of each are in direct contact, as shown in FIG. 5C. In one embodiment, the tabs and/or the pin can be subjected to biasing by a biasing mechanism. For example, in one embodiment, pin 85 may be positioned as shown in FIG. 5C at all times by the biasing mechanism such as, for example, a spring mechanism, whereby the lip latches to the pin by the lip pushing the pin towards the position shown in FIG. 5B by working against the biasing mechanism; accordingly, after the lip latches to the pin, the biasing force pushes the pin right back within the groove formed by the lip to thereby prevent the unintended or accidental unlatching of the lip from the pin.

Figure 5D:
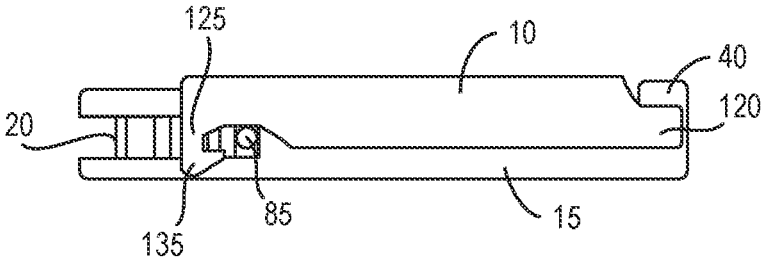
FIG. 5D is a side plan view of one way uncoupling the clip and fastener wherein the clip is about to be uncoupled in accordance with some embodiments of the presently disclosed subject matter.

In one embodiment, when the user desires to uncouple the clip and fastener, the user simply applies pressure to tabs 20, sliding them forward (towards first end 50 of the fastener), as shown in FIG. 5D. Pin 85 is also slid forward through the action of the tabs, thereby releasing the pin from lip 135 of the fastener. In an embodiment where the pin and/or the tab are under the influence of a biasing force, the pin is slid forward against the biasing force. The user then raises the second end 130 of clip 10 away from second end 55 of the fastener, reversing the action shown in FIGS. 5A-5C. Arm 120 can be removed from aperture 45 to fully uncouple the clip and fastener. The fastener (attached to object 16) can then be coupled to a clip positioned at a second location.

Advantageously, the disclosed mounting assembly can be used to easily and quickly move an object from a first location to a second location. The user simply detaches the fastener from a corresponding clip by sliding tabs 20 forward to release lip 135 from pin 85. The user can then reattach the fastener to a clip positioned at a new location by coupling the fastener pin and the lip 135 of the fastener. The assembly is therefore quick and easy to use.

In addition, it should be appreciated that the disclosed mounting assembly is relatively simple and includes only two distinct parts that are used together to provide a releasable connection. Accordingly, there are fewer parts that can be lost compared to prior art attachment mechanisms.

As set forth in detail above, the disclosed assembly allows a use to quickly and easily secure an object (e.g., a gun holster) without necessarily requiring the use of a screwdriver, pliers, or other tools. In addition, the clip and/or fastener can be conveniently removed from an object or location without the use of tools.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

These and other changes can be made to the disclosure in light of the Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed is:

1. A method of making a mounting assembly for a gun holster, the method comprising:

providing a fastener, wherein the fastener is defined by:

a base comprising a top face and an extension positioned at a first end of the top face, the extension defining a central aperture;

a ridge positioned at a second end of the top face, the ridge comprising opposing side faces and a mounting pin spanning a space between the side faces, wherein the mounting pin toggles between a releasing position and a locking position;

providing a clip, wherein the clip is defined by:

a main body comprising a top face and a bottom face;

an arm positioned at a first end of the bottom face of the clip, wherein the arm is configured to fit within the central aperture of the fastener;

a lip positioned at a second end of the bottom face of the clip, wherein the lip engages with the mounting pin at the locking position, and wherein the lip disengages the mounting pin at the releasing position, coupling the clip to the fastener, wherein the clip and fastener are removably coupled.

2. The method of claim 1, wherein the fastener is configured for removably attaching an item thereto.

3. The method of claim 1, wherein an extension of the fastener, the ridge of the fastener, or both extend perpendicularly away from the top face of the base.

4. The method of claim 1, wherein the base, the main body, or both comprise one or more through holes.

5. The method of claim 4, wherein the through holes comprise screw threads.

6. The method of claim 1, wherein the base and the main body are configured to have about the same size, shape, or both size and shape.

7. The method of claim 1, wherein the fastener and the clip are constructed from a rigid material.

8. The method of claim 7, wherein the rigid material comprises one or more of: a metal, plastic, and wood.

9. The method of claim 1, wherein the mounting assembly is configured in an about rectangular shape.

10. The method of claim 1, wherein the ridge further comprises a tab provided on each side face, wherein the tabs are joined by the mounting pin.

11. The method of claim 10, wherein the tabs comprise one or more gripping elements.

12. The method of claim 11, wherein the one or more gripping elements comprise one or more of: raised ridges, rubber grips, and textured regions.

13. The method of claim 10, wherein the tabs are moveable towards the first end of the fastener and are configured such that when the tabs are moved, the mounting pin is correspondingly moved.

14. The method of claim 1, wherein the clip further comprises a tapered segment positioned at a second end of the bottom face of the clip, wherein the tapered segment comprises the lip.

15. The method of claim 2, wherein the item is a gun holster.

16. The method of claim 2, wherein the item is a knife, a tool or a device.

17. The method of claim 1, wherein the clip is configured for attaching to an object.

18. The method of claim 17, wherein the object is a belt of a user or a bag of a user.

19. The method of claim 1, wherein the lip hooks onto the mounting pin in the locking position, and wherein the lip unhooks from the mounting pin in the releasing position.

20. The method of claim 1, wherein the providing of the clip and the fastener comprises one or more of: extrusion, stamping, machining, and injection molding techniques.

* * * * *